US011549327B2

(12) United States Patent
Goff

(10) Patent No.: US 11,549,327 B2
(45) Date of Patent: Jan. 10, 2023

(54) BLOWOUT PREVENTER AND METHOD

(71) Applicant: Malcolm Goff, Rosemary (CA)

(72) Inventor: Malcolm Goff, Rosemary (CA)

( * ) Notice: Subject to any disclaimer, the term of this patent is extended or adjusted under 35 U.S.C. 154(b) by 155 days.

(21) Appl. No.: 17/091,899

(22) Filed: Nov. 6, 2020

(65) Prior Publication Data

US 2021/0131214 A1 May 6, 2021

Related U.S. Application Data

(60) Provisional application No. 62/931,588, filed on Nov. 6, 2019.

(51) Int. Cl.
*E21B 33/06* (2006.01)
*E21B 34/02* (2006.01)

(52) U.S. Cl.
CPC ..... *E21B 33/062* (2013.01); *E21B 34/02* (2013.01)

(58) Field of Classification Search
CPC ..... E21B 33/062; E21B 34/02
USPC ..... 251/1.1, 1.2, 1.3
See application file for complete search history.

(56) References Cited

U.S. PATENT DOCUMENTS 1,592,249 A * 7/1926 Wyatt ..... E21B 33/08 251/1.3
2,177,164 A * 10/1939 Baash ..... E21B 33/06 251/1.3
2,194,255 A * 3/1940 Allen ..... E21B 33/062 251/1.3
2,318,882 A * 5/1943 Nevill ..... E21B 33/062 277/325
2,883,141 A * 4/1959 Oliver ..... E21B 33/062 277/325
6,845,958 B2 * 1/2005 Wood ..... E21B 33/062 251/1.3

* cited by examiner

*Primary Examiner* — Daphne M Barry
(74) *Attorney, Agent, or Firm* — Parlee McLaws LLP

(57) ABSTRACT

An improved ram assembly for a blowout preventer having a design that permits the seals of the ram assembly to be located in the working area and out of the way of threads or other rough/jagged surfaces that could damage the seals in the event of failure of the blowout preventer, such as if the threaded connection fails and the rams are suddenly pushed outwards. The ram assembly can also have a pin-and-groove mechanism that permits the rams to rotate when in the closed/sealing position to account for a misaligned rod. Further, the ram heads of the ram assembly can have a sufficient length such that they remain supported by the bonnet and ram bores of the blowout preventer against radial deflection, relative to the ram bore, when in the closed position and exposed to wellbore pressure. Additionally, the actuators of the ram assembly remain axially stationary during use.

14 Claims, 10 Drawing Sheets

BLOWOUT PREVENTER AND METHOD

CROSS-REFERENCE TO RELATED APPLICATIONS

This application claims the benefit of U.S. Provisional Application 62/931,588, filed Nov. 6, 2019, the entirety of which is incorporated fully herein by reference.

FIELD

Embodiments herein relate generally to wellhead control for oil and/or gas production. In particular, embodiments herein relate to an improved blowout preventer, ram assembly, and method.

BACKGROUND

A blowout preventers (BOPs) are commonly located on oil and gas wellheads used to seal, control, and monitor the operation of oil and gas wells and prevent the uncontrolled release of crude oil, natural gas, or other wellbore fluids therefrom Blowout preventers are designed to protect against sudden wellbore pressure increases and uncontrolled flow emanating from a well reservoir into the wellbore (e.g. a formation kick), such as during drilling. Kicks can lead to a potentially catastrophic event known as a blowout. When a kick, or influx of formation fluid into the wellbore, occurs, the BOP units are actuated to a closed position, either manually or via an automated system. Closing the BOP seals the wellhead therebelow to prevent the flow of fluids or gases out of the wellbore. Once the wellbore has been sealed by the BOP, action can be taken to counteract the kick, such circulating fluid into the wellbore via production tubing to reduce the pressure differential between the wellbore and reservoir. If the integrity of the well is intact, wellbore operations may then be resumed.

In addition to controlling downhole pressure and selectively preventing the flow of oil and gas thereby, blowout preventers are intended to prevent wellbore rods or tubing (e.g. drill pipe, sucker rods, coiled tubing, and the like), tools, and drilling fluid from being forced out of the wellbore in the event of a blowout. BOPs can also be used to fluidly seal the well when downstream equipment is removed or disassembled for servicing. As such, BOPs are critical to the safety of crew, equipment, and environment.

Various types of BOPs are used for various situations. Blind ram BOPs have opposing square-head rams that are designed to seal a wellbore that does not contain a rod string or tubular. Pipe ram or rod ram BOPs have opposing ram heads each comprising a semi-circular cut-out to seal wellbores that have a rod or tubular, such as a string of sucker rods connected end to end and having a polished rod at an upper end of the string, extending therethrough. The opposing ram heads can be actuated to seal with each other and form a complete circumferential seal with the rod therebetween.

BOPs typically consist of a pressure housing with at least one pair of opposing rams actuable between a retracted open or retracted position, wherein the wellbore is not sealed, and a closed or sealing position, wherein the rams seal against each other, the BOP housing, and the rod (if present) extending therethrough to seal the wellbore below the rams. The BOP housing can further comprise outlets that are used for connection to fluid lines, for example to receive production fluid. Typical ram assemblies are secured to the BOP housing by removable bonnets. Unbolting the bonnets from the housing permits maintenance of the BOP and the replacement or substitution of rams. The bonnets typically have seals such that wellbore fluid and pressure cannot escape the BOP housing via the interface between the bonnet and housing.

With reference to FIG. 1, BOP housings typically have a main axial bore for connection in-line with the wellbore, and two or more ram guide cavities or ram bores oriented substantially perpendicularly to the main bore. Opposing rams residing in respective ram bores are actuated to translate axially within the ram bores between the open and closed positions. For rod BOPs, an inward end of the engaging face of each ram has a semicircular cut-out or channel, fit with annular, semi-circular seals, to ensure that a fluid tight seal is created between the rams and the exterior surface of the rod when the rams are in the closed position. The rams are rotatably connected to threaded ram shafts/rods engaged with threads of the bonnet. The ram shafts can be rotated to actuate the rams in the manner of a screw jack. Torque from turning the ram shafts by wrench or hand wheel is converted to linear motion of the ram shafts and the rams coupled thereto. The rams are thereby actuated between the open and closed positions. Such screw jack type operation provides enough mechanical advantage for the rams to overcome downhole pressure and seal the wellbore annulus, with the aid of a pressure balancing port in the ram body.

The ram shafts are sealed with the bonnet to prevent wellbore fluid and pressure from escaping out of the ram assembly in the event the ram seals fail. For example, ram assemblies commonly have a gland seal located at the radially outer end of the bonnet to seal between the ram shaft and bonnet bore. However, if the ram assembly fails in a manner such that the rams are suddenly pushed outwards, for example in the event that the threaded connection between the ram shaft and bonnet fails, the threads of the ram shaft may move through and damage the gland seal, potentially permitting wellbore fluid to escape to the surrounding environment.

Additionally, in some situations, the rod may not be perfectly parallel with the main bore of the BOP. In turn, the ram heads may not engage fully with the rod, as they will not be square with the rod when they are actuated to the closed position. This misalignment can result in ineffective sealing and damage over time to the ram, seals, ram bore, or other components of the BOP.

Moreover, conventional BOP ram heads are relatively short, which can result in the rams "lifting" when engaged with the rod and under wellbore pressure. Specifically, when the rams are in the closed position, wellbore pressure in the main bore below the rams may cause the rams to deflect upwards, resulting in a situation where the bottom edge of the rams are closer to the tubular than the upper edge of the rams. This creates a gap that becomes wider towards the upper edge of the rams. The seals may extrude into the gap under wellbore pressure, which can compromise the sealing engagement between the rams and the rod.

Stuffing boxes are also common components on wellheads, comprising a generally tubular housing having sealing elements located in a bore of the stuffing box, the sealing elements configured to seal with a polished rod extending therethrough to prevent wellbore fluids from escaping thereby. During operation of a pumpjack at surface connected to the polished rod, wherein the polished rod is reciprocated for many cycles, the polished rod may become bent or otherwise deviated from the central axis of the stuffing box bore. Such deviated polished rods may place excessive force on one side of the sealing elements, resulting in premature wear and/or damage to the sealing elements or polished rod. To accommodate for deviation of the polished rod, some stuffing boxes are adjustable in order to align the stuffing box bore with the deviated rod. Such adjustable stuffing boxes typically comprise an upper section, containing the sealing elements, and a lower section, the upper section and lower section capable of becoming misaligned. The lower section is typically mounted to the wellhead stack, and the upper section is adjustably mounted to the lower section. The lower section may also have an enlarged bore to accommodate the deviated polished rod therein.

While adjustable stuffing box designs are capable of accommodating deviated polished rods, they add significant height to the wellhead stack. Pump jacks are usually designed on a case-by-case basis to operate with wellhead stacks up to a certain height. Should components such as adjustable stuffing boxes be added that increase the height of the wellhead stack beyond the maximum height at which the pump jack is capable of operating, the pump jack must be lifted to accommodate the new wellhead height. This requires a significant amount of labour and time, which may lead to prolonged periods during which hydrocarbons cannot be produced from the well. Further, the use of separate adjustable stuffing boxes introduces an additional leak point of the wellhead stack between the upper and lower sections of the stuffing box.

There remains a need for a BOP whose seals will not be damaged in the event of a failure of the BOP, and that will permit an effective sealing engagement with a rod extending therethrough even in cases where the rod is misaligned with the main bore of the BOP.

Further, there is a need for a BOP compatible with a stuffing box capable of accommodating deviated polished rods that may be installed on a wellhead without substantially increasing the height thereof and/or requiring lifting of the pumpjack.

SUMMARY

An improved ram assembly for use with a blowout preventer (BOP) is provided herein having a design that permits the seals of the ram assembly to be located in the working area and out of the way of threads or other rough/jagged surfaces that could damage the seals in the event of BOP failure, such as if the threaded connection fails and the rams are suddenly pushed outwards. The ram assembly can also comprise a pin-and-groove mechanism that permits the rams to rotate when in the closed/sealing position to account for a misaligned rod. Further, the ram heads of the ram assembly can have a sufficient length such that they remain supported by the bonnet and ram bores of the BOP against radial deflection, relative to the ram bore, when in the closed position and exposed to wellbore pressure. Additionally, the actuators of the ram assembly remain axially stationary during use, which saves space and enables more convenient actuation thereof.

In a broad aspect, a ram assembly for connection to a blowout preventer is provided, comprising:

- a bonnet having a bonnet bore extending therethrough;
- a ram shaft axially retained in the bonnet;
- a ram having a ram stem and ram head, the ram threadingly coupled to the ram shaft such that rotation of the ram shaft results in axial translation of the ram while the ram shaft remains axially stationary; and
- ram seals located on the ram head;
- wherein the ram moves toward a sealing position when the ram shaft is rotated in a first rotational direction, and the ram moves toward a retracted position when the ram shaft is rotated in a second rotational direction.

In an embodiment, the ram assembly further comprises a set of one or more annular seals seated in a set of corresponding seal grooves formed in one of the ram and the bonnet for sealing between the ram and the bonnet.

In an embodiment, the ram assembly further comprises an alignment pin extending into the bonnet bore; wherein an alignment groove is defined in the ram; and wherein the alignment pin engages the alignment groove when the ram is in the retracted position.

In an embodiment, the alignment groove is tapered from an outer end of the ram towards an inner end of the ram for permitting the ram to rotate when in the sealing position; and the alignment pin cooperates with the alignment groove to return the ram to an initial orientation when the ram is actuated to the retracted position.

In an embodiment, the ram seals comprise a rod-engaging portion and a circumferential portion.

In an embodiment, the ram shaft comprises a radially extending shaft shoulder; the bonnet comprises a first radial shoulder extending into the bonnet bore; the shaft shoulder and first radial shoulder are configured to abut each another; and the ram assembly further comprises a retaining ring secured in the bonnet bore and positioned such that the shaft shoulder is sandwiched between the first radial shoulder and the retaining ring.

In an embodiment, the bonnet further comprises a second radial shoulder; the ram head and ram stem form a ram shoulder; and the second radial shoulder is configured to abut the ram shoulder when the ram is in the retracted position.

In another broad aspect, a blowout preventer is provided, comprising:

- a housing having a main bore extending therethrough and at least one pair of opposing ram bores oriented substantially perpendicularly to the main bore and in communication therewith;
- two or more ram assemblies, each ram assembly corresponding with a ram bore of the at least one pair of opposing ram bores and comprising:
  - a bonnet having a bonnet bore extending therethrough;
  - a ram shaft axially retained in the bonnet;
  - a ram having a ram stem and ram head, the ram threadingly coupled to the ram shaft such that rotation of the ram shaft results in axial translation of the ram while the ram shaft remains axially stationary; and
  - ram seals located on the ram head;
  - wherein the ram moves toward a sealing position when the ram shaft is rotated in a first rotational direction, and the ram moves toward a retracted position when the ram shaft is rotated in a second rotational direction.

In an embodiment, each of the two or more ram assemblies further comprise a set of one or more annular seals seated in a set of corresponding seal grooves formed in one of the ram and the bonnet for sealing between the ram and the bonnet.

In an embodiment, each of the two or more ram assemblies further comprise an alignment pin extending into the bonnet bore; wherein an alignment groove is defined in the ram; and wherein the alignment pin engages the alignment groove when the ram is in the retracted position.

In an embodiment, the alignment groove is tapered from outer end o the ram towards an inner end of the ram for permitting the ram to rotate when in the sealing position; and the alignment pin cooperates with the alignment groove to return the ram to an initial orientation when the ram is actuated to the retracted position.

In an embodiment, the ram seals of each of the two or more ram assemblies comprise a rod-engaging portion and a circumferential portion.

In an embodiment, the ram shaft of each of the two or more ram assemblies comprises a radially extending shaft shoulder; the bonnet of each of the two or more ram assemblies comprises a first radial shoulder extending into the bonnet bore; the shaft shoulder and first radial shoulder are configured to abut each another; and each of the two or more ram assemblies further comprise a retaining ring secured in the bonnet bore and positioned such that the shaft shoulder is sandwiched between the first radial shoulder and the retaining ring.

In an embodiment, the bonnet of each of the two or more ram assemblies further comprises a second radial shoulder; the ram head and ram stem of each of the two or more ram assemblies form a ram shoulder; and the second radial shoulder is configured to abut the ram shoulder when the ram is in the retracted position.

In an embodiment, the housing has a connection means located at an upper end configured to permit a sealing section of a stuffing box to be connected to the housing.

In an embodiment, the sealing section comprises a flange portion having a plurality of enlarged apertures for cooperating with the connection means to secure the sealing section to the housing, the enlarged apertures permitting a stuffing box axis of the sealing section to be misaligned with an axis of the main bore.

In an embodiment, an upper portion of the main bore has an enlarged diameter.

In an embodiment, the at least one pair of opposing ram bores comprises at least a first and second pair of opposing ram bores, the first and second pair of opposing ram bores being axially and angularly offset relative to each other.

In another broad aspect, a ram assembly for connection to a blowout preventer is provided, comprising:

- a bonnet having a bonnet bore extending therethrough;
- a ram shaft retained in the bonnet;
- a ram coupled to the ram shaft, such that rotation of the ram shaft results in axial translation of the ram; and
- a set of one or more annular seals seated in a set of corresponding seal grooves formed in one of the ram and the bonnet and located axially inwardly of the connection between the ram and ram shaft for sealing between the ram and the bonnet.

In an embodiment, the ram shaft is axially retained in the bonnet such that rotation of the ram shaft results in axial translation of the ram while the ram shaft remains axially stationary.

DESCRIPTION

With reference to FIGS. 2-9, embodiments of an improved ram assembly 30 for a blowout preventer (BOP) 10 are described herein. The ram assembly 30 is mounted to a BOP housing 12 installed on a wellhead stack of a wellbore. The BOP housing 12 comprises a main axial bore 14 that is in-line, and in communication with, the wellbore, and at least one pair of opposing ram bores 16 for housing rams therein. The ram bores 16 are oriented substantially perpendicularly to the main bore 14. Wellbore rods and tubulars, such as rod strings, polished rods, and the like can extend through the main bore 14 of the BOP housing 12 into the wellbore.

Herein, the terms "rod" or "tubing" are used interchangeably unless otherwise stated, and refer to both solid rods and tubular components such as drill pipe, sucker rods, coiled tubing, and the like. The word "proximal" means the direction closer to the user or drive means actuating the ram assembly (and away from the main bore of the BOP), and the word "distal" means the direction farther from the user or drive means actuating the ram assembly (and towards the main bore of the BOP). The word "inner" means the direction towards the main axial bore of the BOP, while "outer" means the direction away from the main axial bore.

Figure 1:
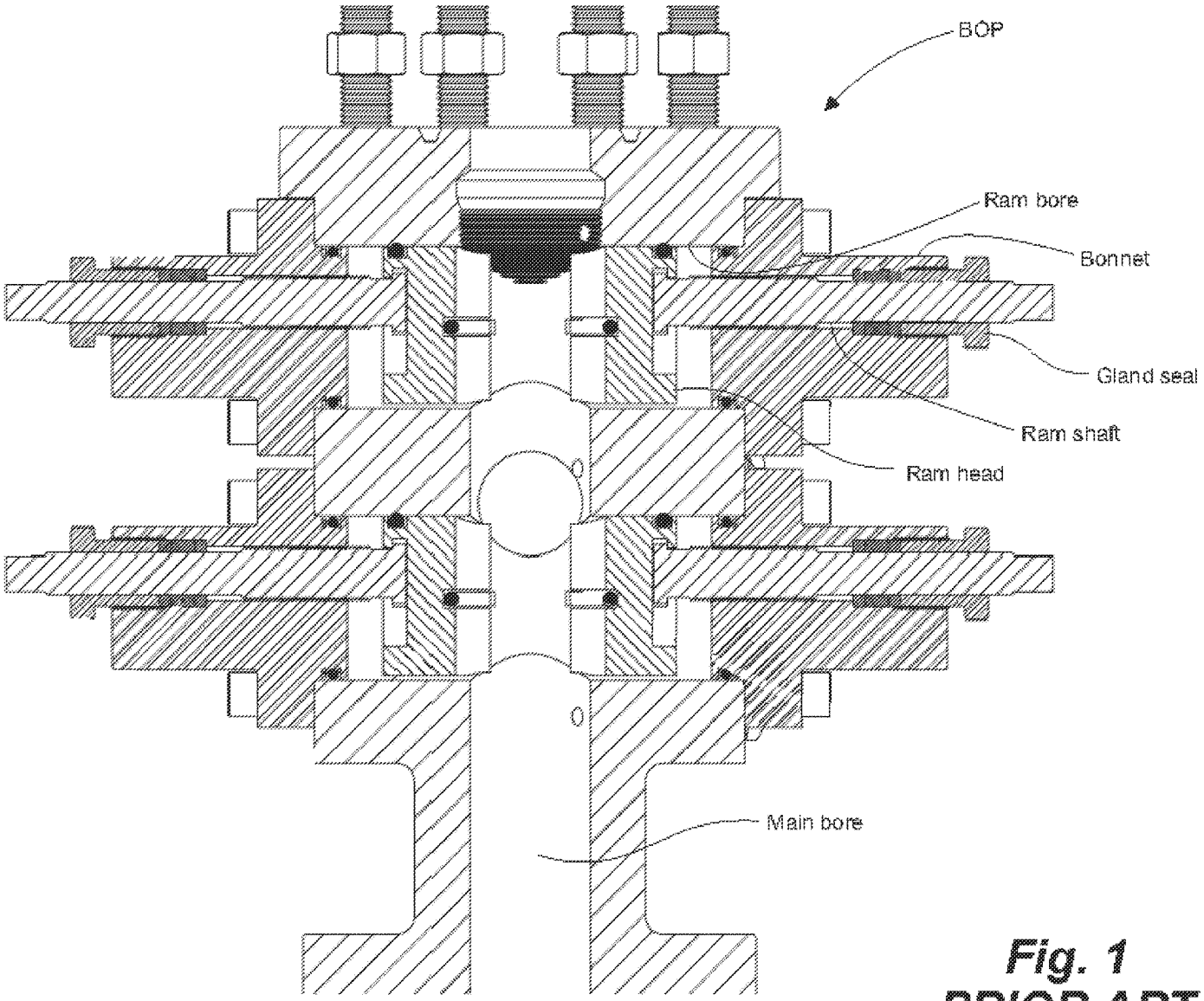
Fig. 1 PRIOR ART
FIG. 1 is a cross-sectional elevation view of a prior art blowout preventer.
Figure 2:
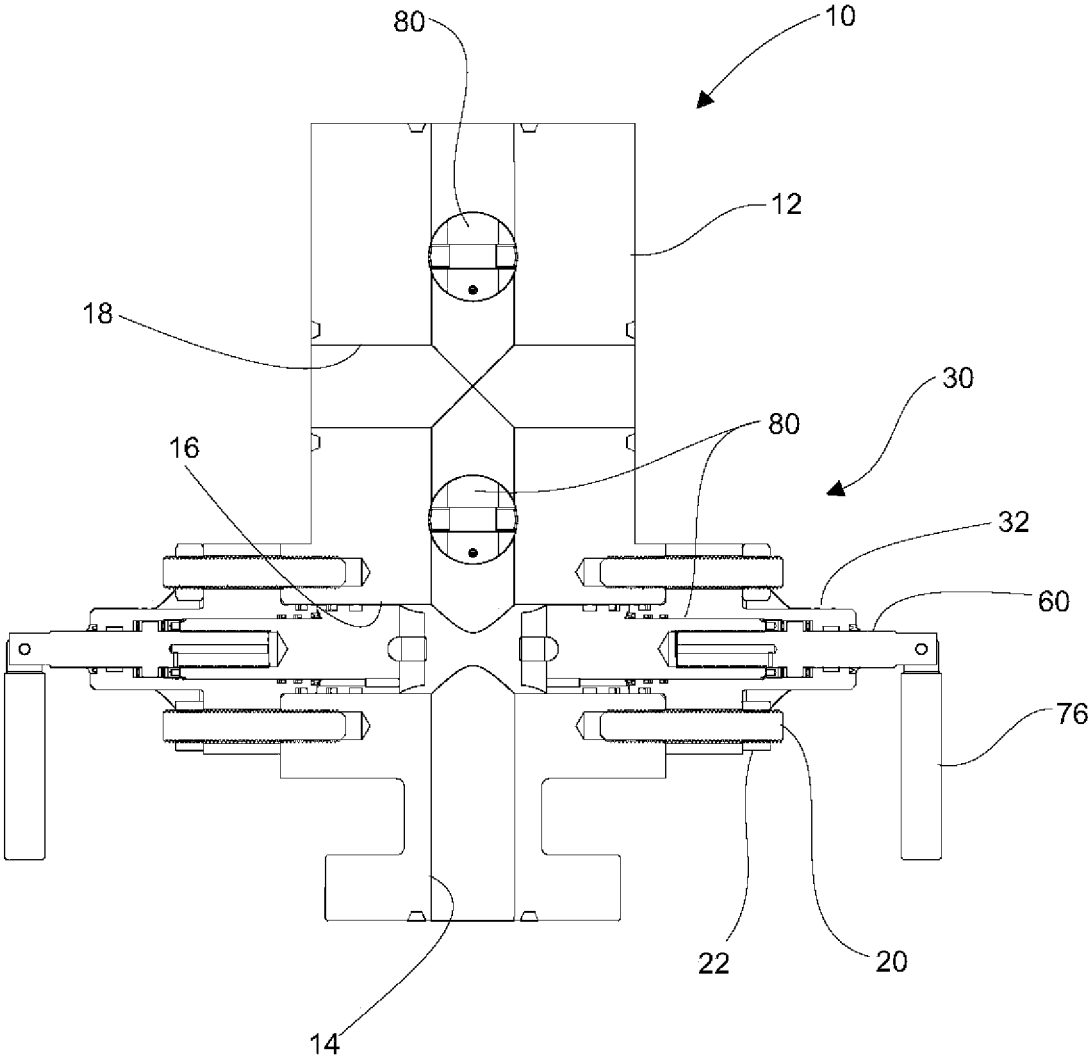
FIG. 2 is a cross-sectional elevation view of an embodiment of a blowout preventer having improved ram assemblies.
Figure 3:
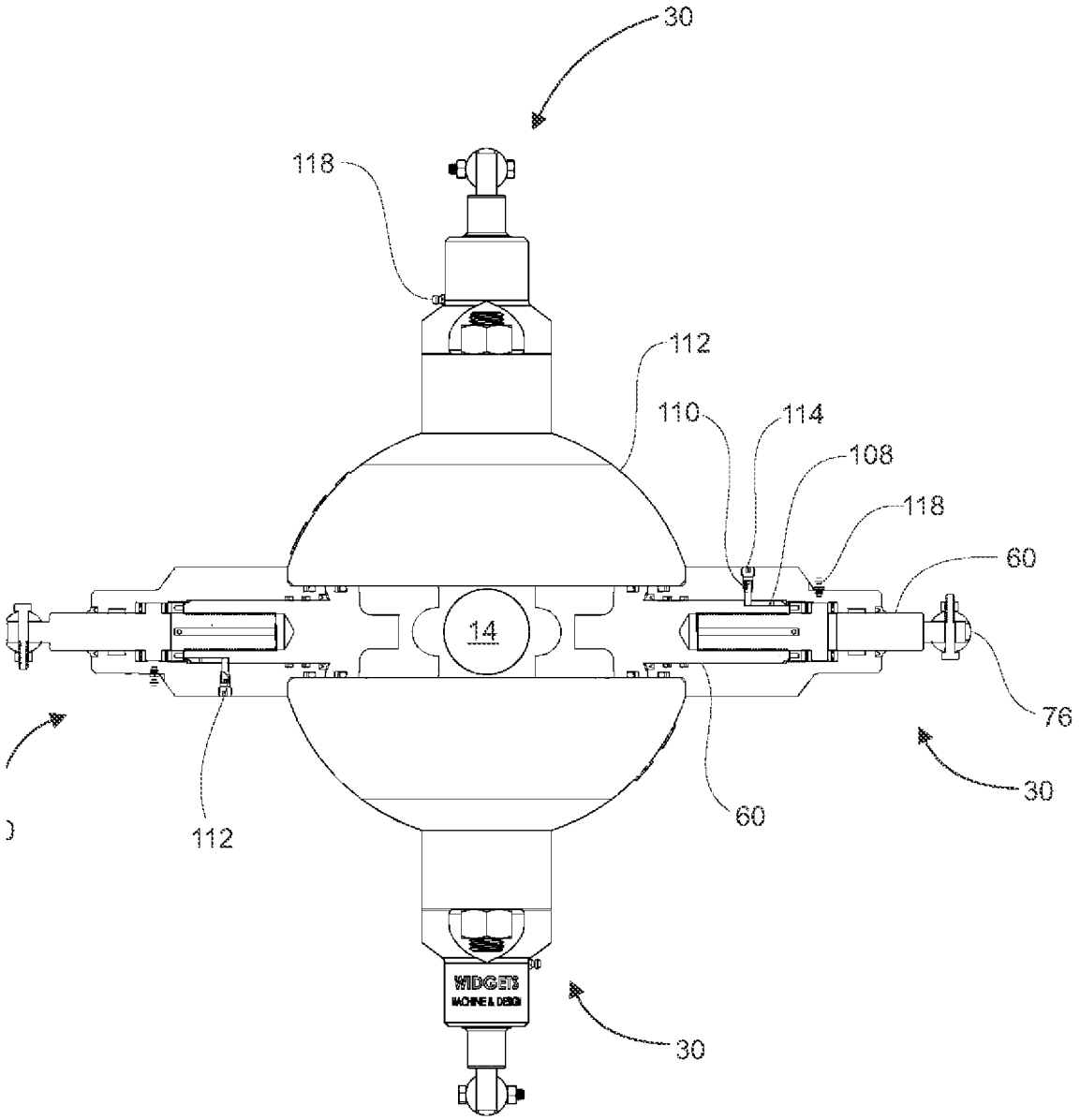
FIG. 3 is a cross-sectional top view of the blowout preventer of FIG. 2.

Generally, with reference to FIGS. 2 and 3, the improved ram assembly 30 comprises a bonnet 32, a ram shaft 60, and a ram 80. The bonnet 32 is configured to be mounted onto the BOP housing 12, and the ram shaft 60 is rotatably retained in the bonnet 32. The ram 80 is coupled with the ram shaft 60 and is configured to axially translate towards or away from the main bore 14 in response to rotation of the ram shaft 60, for example via a threaded connection between the ram 80 and ram shaft 60. Seals for isolating wellbore pressure within the BOP 10 can be located in the working area of the BOP, and not in the path of any threads or other structures of the ram assembly 30 that could damage the seals in the event of failure of the threads.

Figure 5:
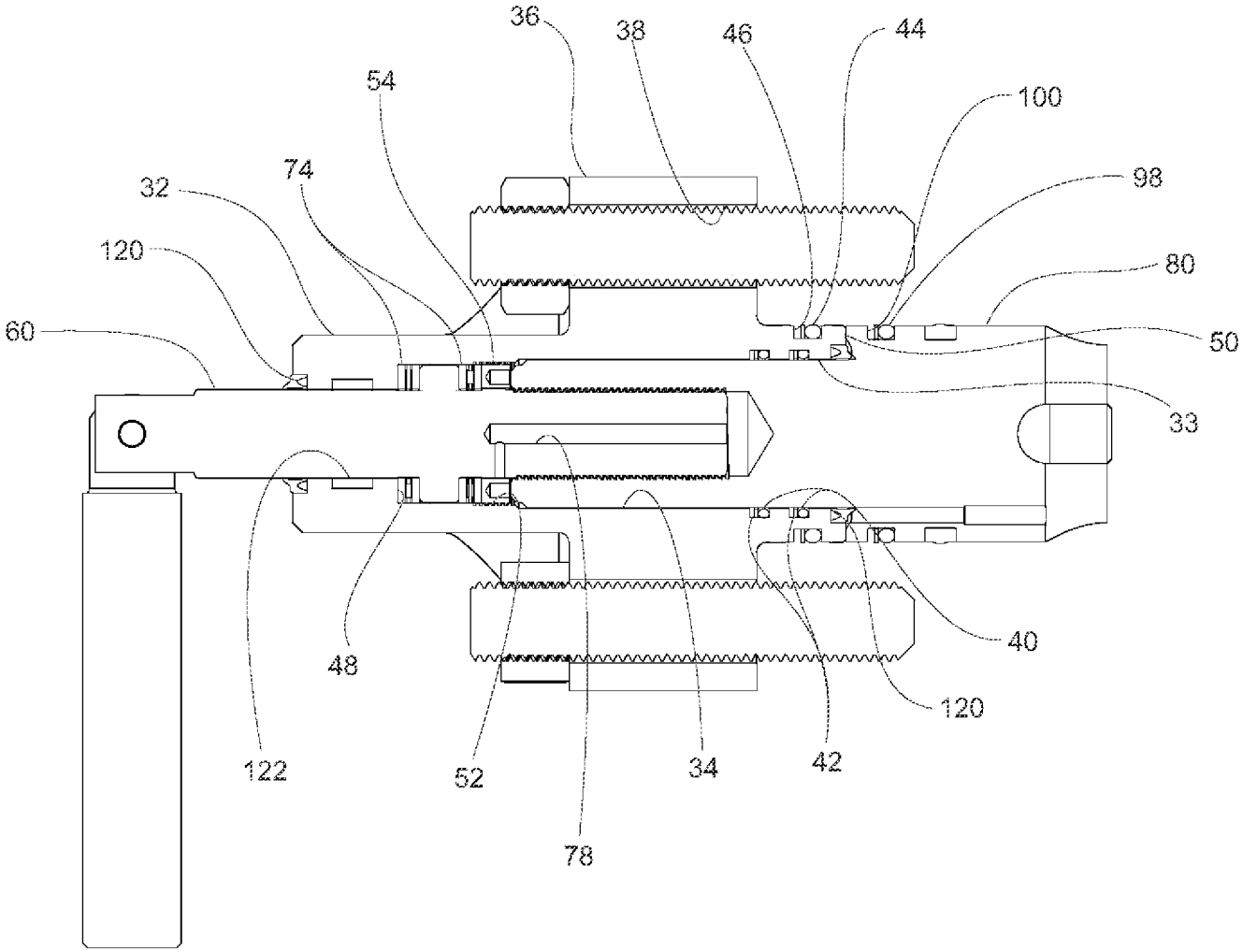
FIG. 5 is a cross-sectional elevation view of the ram assembly of the blowout preventer of FIG. 2.

In detail, with reference to FIG. 5, the bonnet 32 comprises a mounting means for securing the bonnet to the BOP housing. For example, a plurality of apertures 38 can be formed in a flange portion 36 of the bonnet and positioned to receive fasteners, such as threaded studs and bolts. The studs 20 can be threaded into corresponding holes formed in the BOP housing 12, and received through the apertures 38 of the bonnet 32. Nuts 22 or other suitable fasteners can be threaded onto the studs 20 to secure the bonnet 32 to the housing 12. In other embodiments, the bonnet 32 can have a threaded portion and be threaded into the corresponding ram bore 16 of the BOP housing 120.

Figure 9:
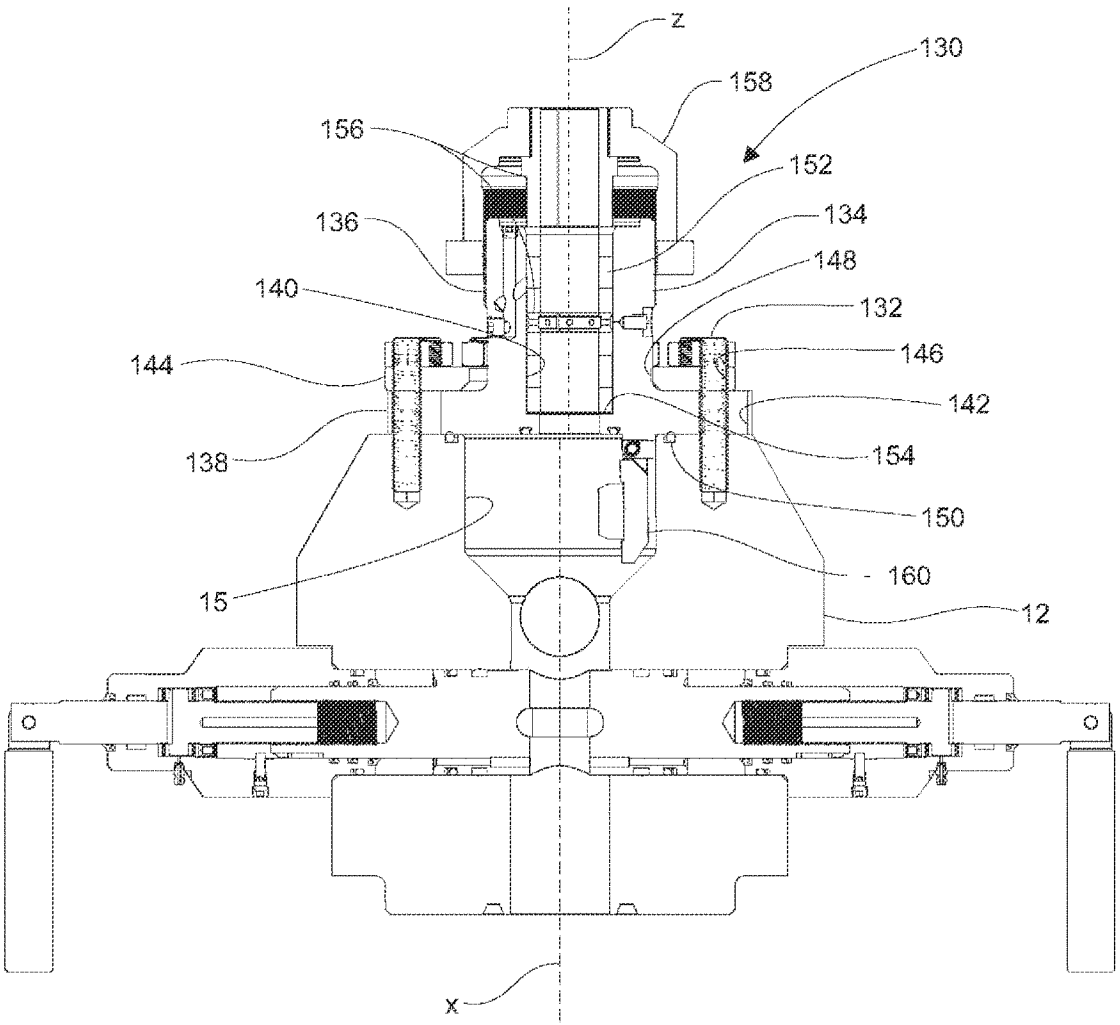
FIG. 9 is a cross-sectional elevation view of an embodiment of a blowout preventer having a main bore with an enlarged upper end for cooperating with an adjustable stuffing box.

With references to FIGS. 2 to 5, the bonnet 32 further comprises a bonnet bore 34 for receiving the ram shaft 60 and ram 80 therein. A first set of one or more annular seals 40, such as o-rings, can be seated in a first set of corresponding seal grooves 42 formed in the bonnet bore 34 or a side wall 82 of the ram 80 and positioned to create a seal between the bonnet bore 34 and the ram 80. A second set of one or more seals 44 can be seated in a second set of corresponding seal grooves 46 formed in the bonnet 32 or the BOP housing 12 and positioned to create a seal between the bonnet 32 and the BOP housing 12. For example, as shown in FIGS. 2, 5, and 9, the bonnet can form an inner neck 33 extending into the ram bore 16 of the BOP 10, and the second set of seals 44 can be located in an exterior wall of the inner neck 33. In other embodiments, the second set of seals 44 can be located on an inner face of the flange portion 36 of the bonnet 32, or another suitable location, to create a seal between the bonnet 32 and the BOP housing 12.

The bonnet 32 further comprises a first radial shoulder 48 extending into the bonnet bore 34 for retaining the ram shaft 60, and retaining threads or other retaining means 52 formed in the bonnet bore 34 for coupling with a retaining ring or nut 54, which is described in further detail below. In embodiments, the bonnet 32 can also comprise an optional second radial shoulder 50 located at an inner end thereof for abutting the ram 80 and retaining the ram 80 in the ram 16 bore during use.

With reference to FIGS. 4 to 8 the ram shaft 60 is a generally cylindrical or tubular member comprising an inner portion 66, an outer portion 70, and a radially extending shaft shoulder 72 therebetween configured to abut the first radial shoulder 48 of the bonnet 32 when the ram assembly 30 is assembled. In an embodiment, two annular bearings 74 flank the first shoulder to facilitate rotation of the ram shaft 60 within the bonnet bore 34. In embodiments, the annular bearings 74 are bearing assemblies comprising an annular bearing, such as a needle roller bearing, flanked by two washers. The bearings 74 can be occasionally greased to further promote rotation of the ram shaft 60. The outer portion 70 of the ram shaft 60 can be connected to an actuator 76, such as a drive motor, hydraulic actuator, hand crank, or other suitable actuators for rotating the ram shaft 60 in first and second rotational directions.

As mentioned above, a retaining ring or nut 54 can be used to secure the ram shaft 60 in the bonnet bore 34. Specifically, the retaining ring 54 can be coupled with retaining means, such as threads 52, within the bonnet bore 34 to sandwich the shaft shoulder 72 of the ram shaft 60 between the first radial shoulder 48 of the bonnet and the retaining ring 54. The bearings 74 can be located between the shaft shoulder 72 and first radial shoulder 48, and between the shaft shoulder 72 and the retaining ring 54, to facilitate rotation of the ram shaft 60.

In embodiments, the ram shaft 60 can have a first pass-through channel 78 formed therethrough to equalize the pressure between the portion of the ram shaft 60 connected to the ram 80, and the portion of the ram shaft 60 proximal from the ram 80. Such pressure equalization enables the ram 80 to move more easily between the retracted and sealing positions.

With reference to FIGS. 4 to 7, the ram 80 comprises a ram head 88 and a ram stem 90. The ram head 88 is a generally cylindrical portion comprising an inner face 92 for engaging the rod and a circumferential side wall 82. In the depicted embodiments, the ram head 88 and ram stem 90 have different diameters, the head 88 having a larger diameter, thus forming a ram shoulder 94 that can be configured to abut the second radial shoulder 50 of the bonnet 32, if present, when the ram 80 is in the retracted position. In other embodiments, the ram head 88 and ram stem 90 can have the same diameter. The ram head 88 further comprises channels running across its inner face 92 and around its side wall 82 for receiving ram seals 96 configured to seal with the rod, ram bore 16, and the ram head 88 of an opposing ram 80 when the rams 80,80 are actuated to the sealing position. As best shown in FIGS. 6A and 6B, the ram seals 96 can comprise a rod-engaging portion 96*a* and a circumferential portion 96*b*. A third set of one or more annular seals 98 can be seated in a third set of corresponding seal grooves 100 formed in the side wall 82 of the ram head 88 or the ram bore 16, for example proximal of the ram seals 96, and configured to seal between the ram head 88 and ram bore 16. In embodiments, a second flow-through channel 102 can extend from an inner end 84 located at the inner face 92 of the ram head 88 towards an outer end 86 of the ram head 88 to equalize the pressure therebetween, thus facilitating actuation of the ram 80 between the retracted and sealing positions.

The ram stem 90 is a generally tubular portion extending from the ram head 80 and comprises a threaded portion 104 for connecting the ram 80 with the ram shaft 60. For example, a stem bore 106 extending from the outer end 86 of the ram 80 can comprise internal threads 104. The stem bore 106 is configured to couple with the threads 68 of the inner portion 66 of the ram shaft 60. An outer side wall of the ram stem 90 can be substantially smooth to provide a suitable sealing surface for the first set of seals 40 of the bonnet 32 to seal against. In embodiments, the first set of seals 40 and first seal grooves 42 can be located in the outer side wall 82 of the ram as opposed to the bonnet, and the sidewall of the bonnet bore 34 can be substantially smooth to provide a suitable sealing surface for the first set of seals 40 to seal against.

Figure 4:
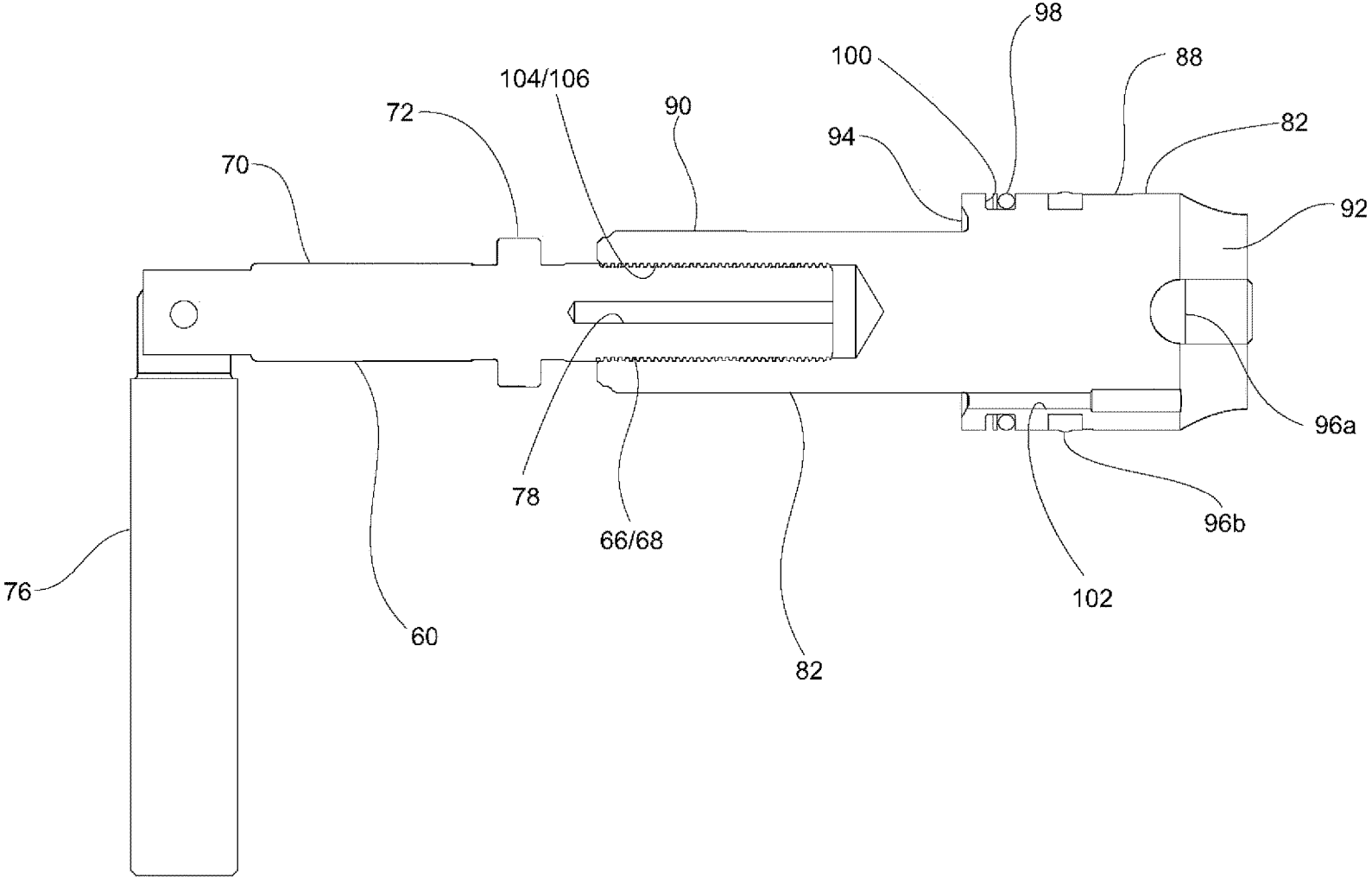
FIG. 4 is a cross-sectional elevation view of the ram and ram shaft of the blowout preventer of FIG. 2.

While FIGS. 2, 4, and 5 depicts the ram stem 90 as having an internally threaded stem bore 106, in embodiments, the ram stem 90 can be externally threaded and threadingly received inside a shaft bore of the ram shaft 60. In such embodiments, the ram shaft 60 can have a substantially smooth outer side wall to provide a suitable sealing surface for the first set of seals 40 of the bonnet to seal against, or the first set of seals 40 and first seal grooves 42 can be located in the outer side wall of the inner portion 66 of the ram shaft 60 for sealing with the sidewall of the bonnet bore 34.

Figure 6A:
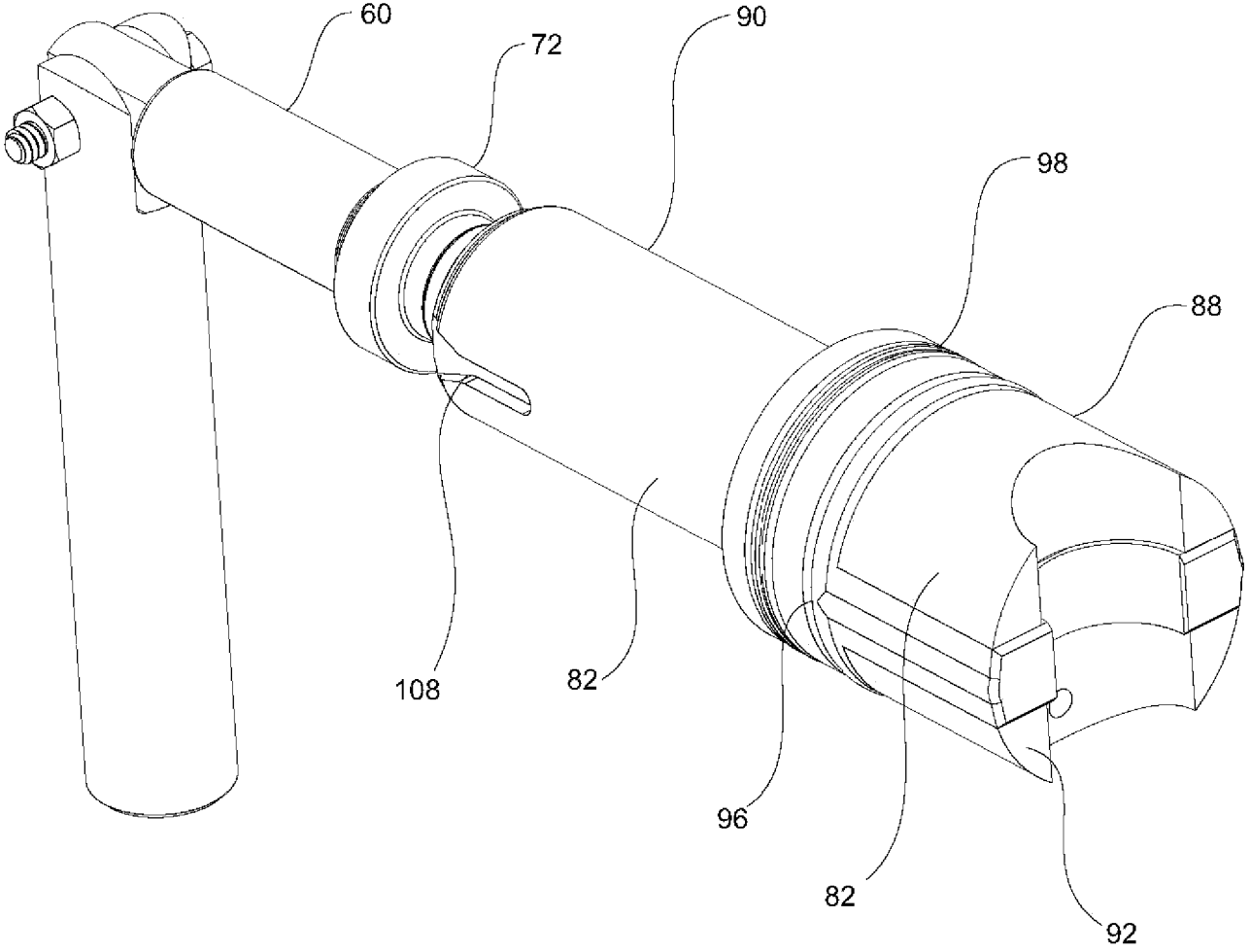
FIG. 6A is a perspective view of a ram and ram shaft of the blowout preventer of FIG. 2.
Figure 6B:
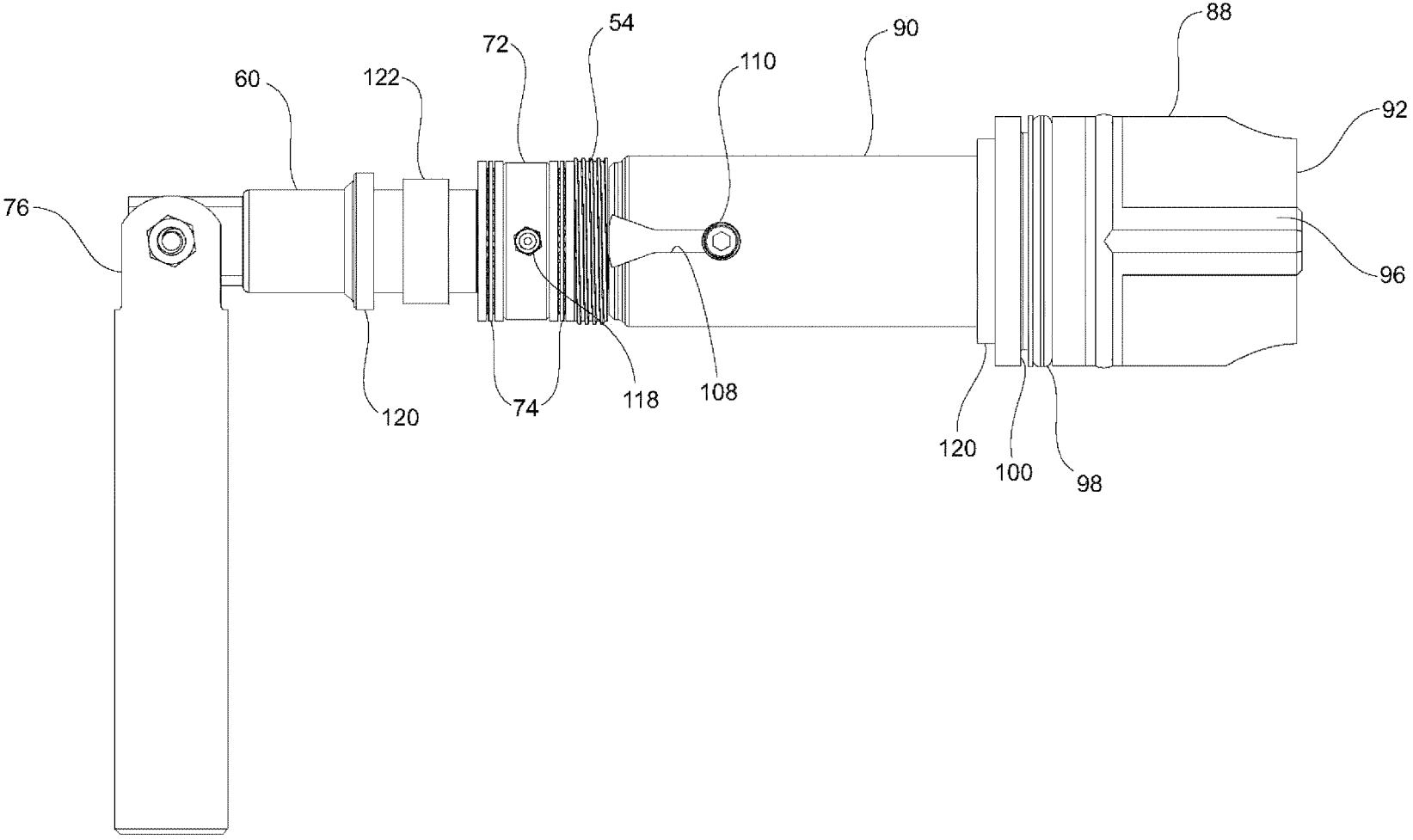
FIG. 6B is a side elevation view of a ram and ram shaft of the blowout preventer of FIG. 2.
Figure 7:
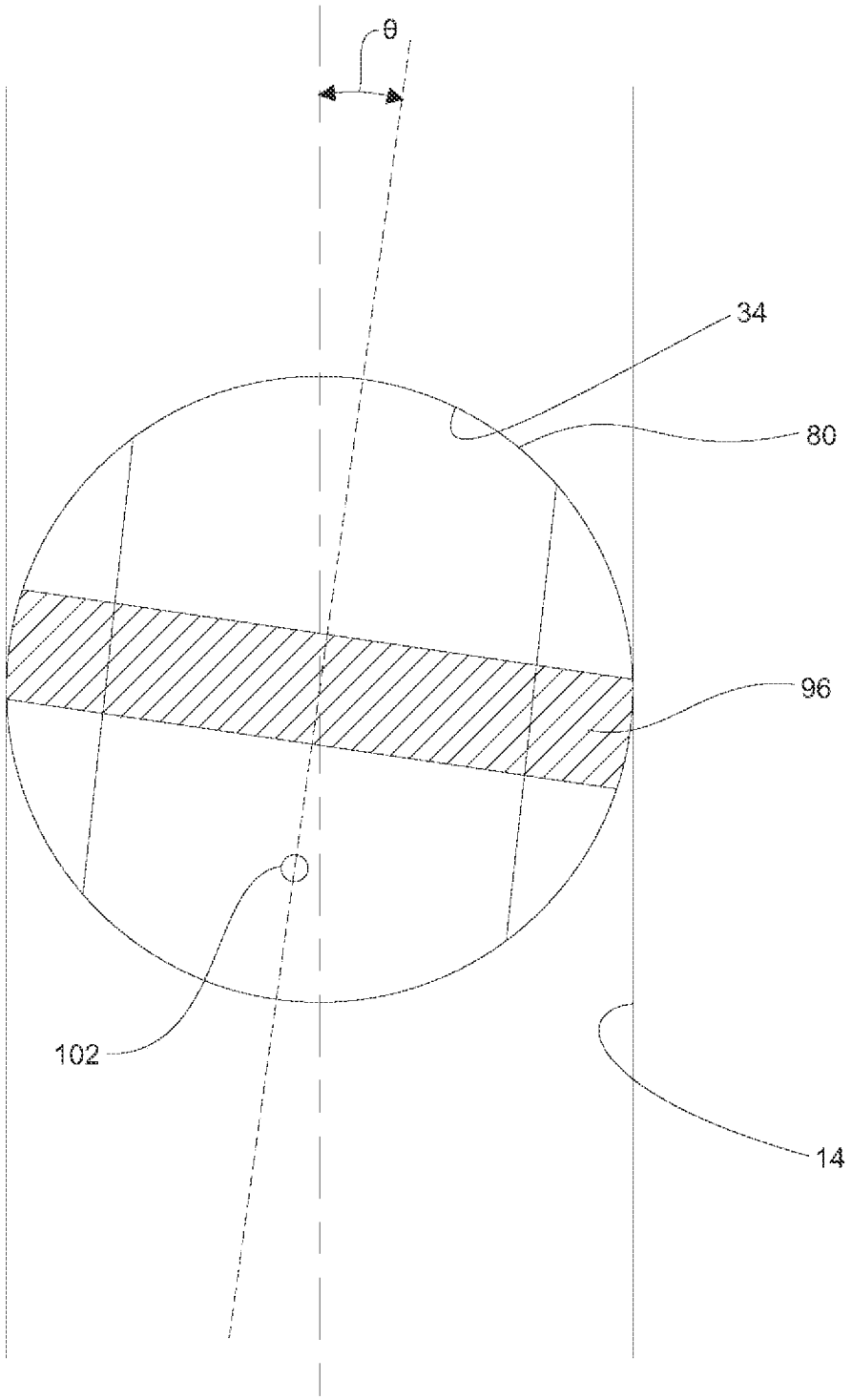
FIG. 7 is a detail side view of a ram rotationally misaligned with a main bore of a blowout preventer.
Figure 8:
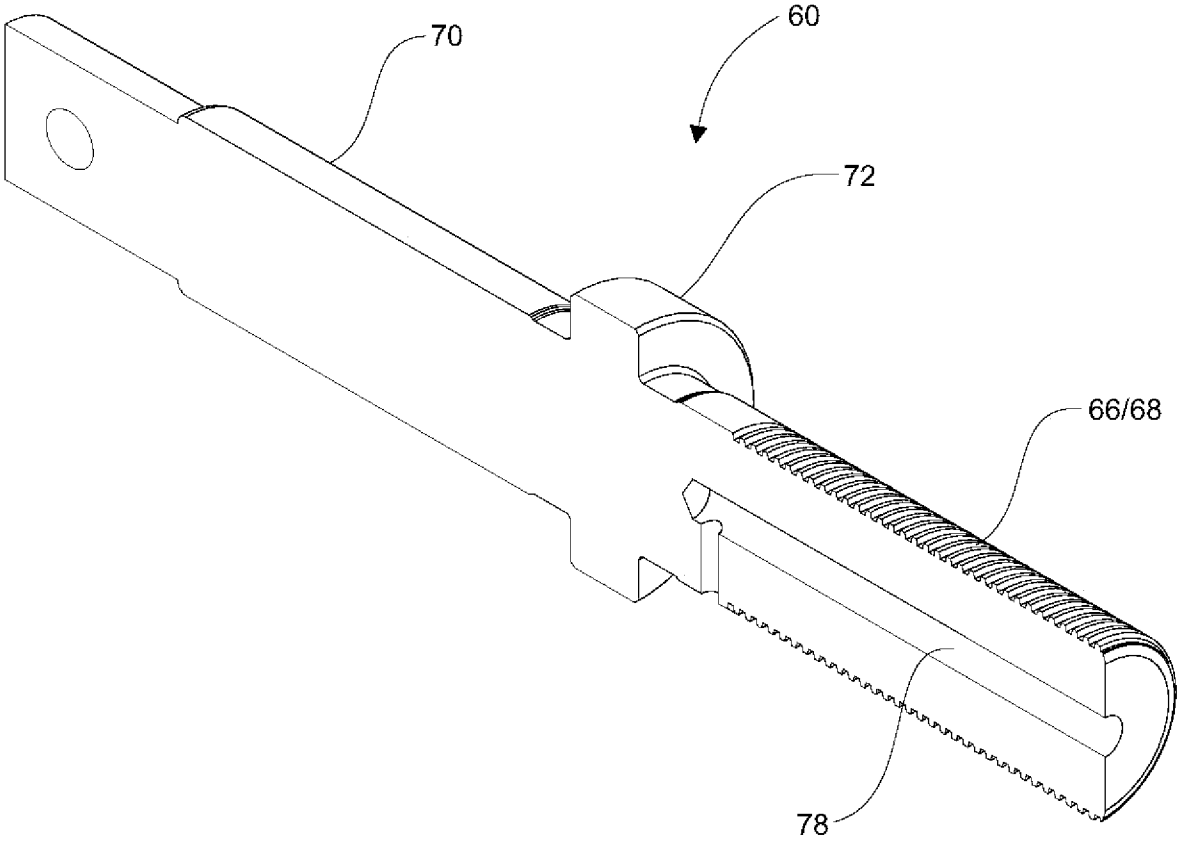
FIG. 8 is a perspective cross-sectional view of a ram shaft of the blowout preventer of FIG. 2.

In embodiments, as best shown in FIGS. 6A and 6B, an alignment groove 108 can be formed in the outer side wall 82 of the ram stem 90. An alignment pin 110 can extend through the bonnet 32 into the bonnet bore 34 to engage the alignment groove 108. The alignment groove 108 can be tapered from the outer end 86 of the ram 80 towards the inner end 84, such that the alignment pin 110 rotationally aligns the ram 80 when it is actuated to the retracted position, but permits the ram 80 to have a degree of "float" when it is actuated to the sealing position, thus being free to rotate to align with the rod. With reference to FIG. 6B, this freedom of rotation relative to the BOP housing 12 enables the ram 80 to rotate and align itself with a rod that may be misaligned with the main bore 14, such that it is offset by an angle θ relative to the axis X of the main bore 14, and therefore more effectively seal with the rod therein when actuated to the sealing position. When the rams 80 are actuated back to the retracted position, the alignment pin 110 guides the ram 80 such that it rotates back to its original orientation and θ returns to zero.

As best shown in FIGS. 2 and 3, multiple pairs of opposing ram assemblies 30,30 can be connected to the BOP housing 12. In embodiments, the pairs of ram assemblies 30,30 can be axially spaced along the main bore 14 and angularly offset from other ram pairs 30,30. In this manner, the angularly offset ram pairs 30,30, each capable of rotating within their respective ram bores 16 due to the float permitted by their respective alignment pin 110 and alignment groove 108 engagements, can accommodate deflection of the rod in the main bore 14 along various planes.

For example, the bonnet 32 can have a radial alignment port 112 configured to receive alignment pin 100. The alignment pin 100 can be inserted through the alignment port 112, such that it extends into the bonnet bore 34 to engage the alignment groove 108 of the ram 80 therein. In embodiments, a pressure plug 114 can be secured in the alignment port 112 to prevent pressure and fluid from escaping therethrough, for example in the event of failure of the first and second sets of seals 42,44. The alignment pin 110 and pressure plug 114 can be secured in the alignment port 112 by any suitable means, such as via a threaded connection.

The ram head 88 can also be of a sufficient length such that it remains supported by the ram bore 16 and/or bonnet bore 34 against radial deflection relative to the axis Y of the ram bore 16 when in the sealing position, thereby mitigating the lift that occurs when the rams 80 are exposed to high wellbore pressure when in the sealing position and engaged with the rod.

In some embodiments, as best shown in FIG. 3, a grease channel 116 can be formed in the bonnet 30 to direct grease to the shaft shoulder 72 of the ram stem 60 and the adjacent bearings 74. A grease fitting can be installed at a grease port 118 connected to the grease channel 116 and the grease channel 116 can terminate at or adjacent the location of the ram bore where the shaft shoulder 72 of the ram stem 60 resides when the ram assembly 30 is assembled. As the areas of the ram assembly 30 proximal from the sets of seals 42,44,98 is not at wellbore pressure, the grease fitting need not be capable of withstanding wellbore pressure and the grease port 118 does not need to be plugged except as a precaution in the event of failure of the seals 42,44,98.

The ram assembly 30 described above is advantageous over the prior art as it enables the seals of the ram assembly 30 to be located in the working area and inwardly of the threaded connection between the ram 80 and ram shaft 60. Such location of the seals mitigates the risk that the seals will become damaged if the threaded connection fails, and consequently presents a lower risk that wellbore pressure and fluid will be released into the environment in the event failure of the threads.

Further, the described ram assembly permits the ram heads 88 to have a degree of rotation when in the sealing position to account for potential misalignment of the rod, while also providing longer ram heads to mitigate "lift" of the rams 80.

Further, the relatively long ram heads 88 support the rams 80 against radial deflection relative to the axis Y of the ram bores 16 when engaged with the rod in the sealing position.

As one of skill in the art would understand, modifications could be made to aspects of the ram assembly 30 disclosed herein without deviating from the scope of the invention. For example, first and second wiper seals 120 could be located at the outer and inner ends of the bonnet 32, respectively. The first wiper seal 120*a* located at the outer end of the bonnet 32 can be configured to keep the outer portion 70 of the ram shaft 60 clean, and the second wiper seal 120*b* can be configured to keep the ram stem 90 clean. Wiper seals 120 can be positioned at other locations of the ram assembly 30 as well. A hydraulic wear ring 122 can also be located in the bonnet bore 34 to reduce wear on the bonnet bore 34 or ram shaft 60 caused by the rotation of the ram shaft 60 therein.

Operation

In use, the improved ram assembly 30 can be actuated from the retracted position to the sealing position by rotating the ram shaft 60 in the first rotational direction using the actuator 76. The ram shaft 60 rotates within the bonnet 32, but remains axially stationary relative thereto as it is axially retained in the bonnet bore 34 by the first radial shoulder 48 and the retaining ring 54. The ram 80, coupled to the ram shaft 60 via the threaded engagement, is prevented from rotating with the ram shaft by the alignment pin 110 and friction between the ram 80 and the bonnet and ram bores 34,16, as well as by the seals 40,98. The rotational motion of the ram shaft 60 is translated to axial movement of the ram 80 towards the main bore 14. The ram shaft 60 is rotated until the ram 80 reaches the sealing position and sealingly engages the rod and the opposing ram 80. When the ram 80 is in the sealing position, the alignment pin 110 is in the wider portion of the alignment groove 108 of the ram 80, thus permitting the ram 80 to rotate within the ram bore 16 to accommodate some deviation of the rod from the main bore axis X. The ram 80 can be retracted to the retracted position by rotating the ram shaft 60 in the opposite, second rotational direction. During the opening and closing procedures, the ram seals 96 and the first, second, and third sets of seals 40,44,98 contain wellbore pressure within the BOP housing 12.

As one of skill in the art would understand, unlike with conventional BOP designs, failure of the threaded engagement between the ram shaft 60 and ram 80 will not damage the seals 40,44,98, as the threaded engagement is located outside of the working area and are out of the way of the threads of the ram 80 and ram shaft 60, and other structures that could damage them. Therefore, even though the threaded engagement has failed, the seals 40,44,98 remain undamaged and continue to contain wellbore pressure within the BOP 10. Should the threads fail, the shoulder 94 of the ram 80 will be forced against the second radial shoulder 50 of the bonnet and/or the ram stem 90 will but against the retaining ring 54 and/or the 1$^{st}$ radial shoulder 48. The seals 40,44,98 are not exposed to threads or other rough or jagged surfaces, and are therefore not damaged by the backing out of the ram 80. As the ram shaft 60 already abuts the first radial shoulder of the bonnet 48, and the bonnet 32 is secured to the BOP housing 12, the ram shaft 60 will not move in the event of such a failure.

Stuffing Box Connection

With reference to FIG. 9, in embodiments, the BOP housing 12 can have connection means to permit stuffing box components to be mounted directly thereto. In particular, the sealing components of an adjustable stuffing box 130 can be mounted directly to the BOP housing 12 without the need for a lower stuffing box section. For example, an adjustable stuffing box 130 as described in Applicant's U.S. application Ser. No. 15/874,468, now issued as U.S. Pat. No. 10,619,444, the entirety of which is incorporated herein by reference, can be mounted to an upper end of the BOP housing 12. An upper portion 15 of the BOP main bore 14 can be enlarged accordingly to accommodate deviation of the polished rod extending therethrough from the axis X of the main bore 14. Further, connection means such as a plurality of studs 132 can be installed in a plurality of circumferentially spaced threaded bores located at the upper end of the BOP housing 12 for securing the stuffing box components to the BOP housing 12.

The stuffing box components can comprise a generally tubular sealing section 134 having a neck portion 136, a flange portion 138, and a stuffing box bore 140 extending therethrough and centered about a stuffing box axis Z. A first plurality of apertures 142 corresponding with the plurality of studs 132 is formed in the flange portion. The first plurality of apertures 142 are configured to receive the plurality of studs 132 therethrough and have a diameter significantly larger than that of the studs 132 so as to permit the sealing section 134 to shift laterally relative to the BOP housing 12, that is, so that the stuffing box axis Z and central bore axis X may be misaligned, when the plurality of studs 132 are inserted through the first plurality of apertures 142. The maximum degree of misalignment between the axes X,Z is determined by the clearance between the plurality of studs 132 and the first plurality of apertures 142.

The stuffing box components further comprise a retaining plate 144 having a second plurality of apertures 146 also configured to receive the plurality of studs 132 therethrough, and a central opening 148 for receiving the neck portion 136 of the sealing section 134 therethrough. The second plurality of apertures 146 can have a diameter corresponding with the diameter of the plurality of studs 132, such that the retaining plate 144 cannot shift laterally relative to the BOP housing 12 by a significant degree when the plurality of studs 132 are inserted through the second plurality of apertures 146. An annular seal 150 can be located at a sealing face 139 of the flange portion 138 to create a seal between the sealing section 134 and BOP housing 12 when the sealing section 134 is secured to the BOP housing 12.

One or more annular stuffing box seals 152 can be located in the stuffing box bore 140 and configured to seal against the polished rod extending therethrough, thus preventing fluids from leaking to the surrounding environment. The stuffing box seals 152 can be seated on an annular shoulder 154 extending radially inwards adjacent a bottom end of the sealing section 134.

A top cap 158 can be secured, such as via a threaded connection, to the neck portion 136 of the sealing section to compress and energize the stuffing box seals 152.

In embodiments, one or more annular bushings 156 can be located in the stuffing box bore 140 or top cap 158 for protecting the stuffing box 152 seals from excessive wear from the movement of the polished rod extending therethrough and to assist in aligning the polished rod with the stuffing box bore 140.

A valve 160, such as a flapper valve actuable between an open position for permitting the rod to extend therethrough, and a closed position for sealing the stuffing box bore 140 from wellbore pressure and fluids, can be located at a downhole end of the stuffing box bore 140. A resilient element, such as a spring, can be used to bias the valve 160 to the closed position such that the valve 160 will close if the polished rod is no longer present in the stuffing box bore 140 adjacent the valve 160, such as when the rod string breaks and the polished rod is ejected from the BOP main bore 14 and stuffing box bore 140. A valve seal, such as an annular seal located in the sealing face of the flange portion 138, can be configured to create a seal between the sealing section 134 and the valve 130 when the valve is in the closed position. In other embodiments, the valve 160 can any other suitable type of valve, such as a ball residing in a side chamber of the BOP main bore 14 and configured to float up and block the stuffing box bore 140 in the vent the rod string is ejected from the bore 140, such as in the event of breakage of the rod string.

To install the stuffing box components on the BOP housing 12, the sealing section 134 is first installed on the BOP housing 12 such that the plurality of studs 132 of the BOP extend through the first plurality of apertures 142, and the retaining plate 144 can then be installed such that the plurality of studs 132 extend through the second plurality of apertures 146, and the neck portion 136 extends through the central opening 148 of the retaining plate 144. A plurality of fasteners, such as nuts, can be threaded on the studs 132 to sandwich the flange portion 138 of the sealing section 134 between the BOP housing 12 and the retaining plate 144. To align the stuffing box axis Z with the polished rod, the plurality of fasteners can be loosened and the polished rod reciprocated. With the fasteners loosened, the sealing section 134 is permitted to shift laterally to align itself with the movement of the polished rod. Once the sealing section 134 has been aligned with the polished rod, the fasteners can be tightened to prevent the sealing section 134 from shifting when the pump jack is in use.

In embodiments, referring to FIGS. 2 and 9, one or more outlet ports 18 may be formed in the BOP housing to permit fluids produced from the wellbore to be directed to storage or other components downstream.

Configuring the BOP housing 12 such that stuffing box components may be mounted directly thereto, and having outlet ports formed integrally therewith, is advantageous, as such a design provides a shorter wellhead stack, and eliminates a potential leak point of the stack where a bottom section of a stuffing box 130 would typically be connected to the BOP housing 12.

As one of skill in the art would understand, the BOP housing 12 can be modified to accommodate a variety of stuffing box designs, and the above illustrates one possible configuration of an integrated BOP housing 12 and stuffing box 130. For example, the rod seal-containing section of a non-adjustable stuffing box can be mounted directly to the BOP housing 12 to provide the same advantages of reduced stack height and fewer leak points.

I claim:

1. A ram assembly for connection to a blowout preventer, comprising:

a bonnet having a bonnet bore extending therethrough;

a ram shaft axially retained in the bonnet;

a ram having a ram stem and ram head, the ram threadingly coupled to the ram shaft such that rotation of the ram shaft results in axial translation of the ram while the ram shaft remains axially stationary; and ram seals located on the ram head;

wherein the ram moves toward a sealing position when the ram shaft is rotated in a first rotational direction, and the ram moves toward a retracted position when the ram shaft is rotated in a second rotational direction, and further comprising an alignment pin extending into the bonnet bore:

wherein an alignment groove is defined in the ram and the alignment groove is tapered from an outer end of the ram towards an inner end of the ram for permitting the ram to rotate when in the sealing position; and the alignment pin cooperates with the alignment groove to return the ram to an initial orientation when the ram is actuated to the retracted position.

2. The ram assembly of claim 1, further comprising a set of one or more annular seals seated in a set of corresponding seal grooves formed in one of the ram and the bonnet for sealing between the ram and the bonnet.

3. The ram assembly of claim 1, wherein the ram seals comprise a rod-engaging portion and a circumferential portion.

4. The ram assembly of claim 1, wherein:

the ram shaft comprises a radially extending shaft shoulder;

the bonnet comprises a first radial shoulder extending into the bonnet bore;

the shaft shoulder and first radial shoulder are configured to abut each another; and the ram assembly further comprises a retaining ring secured in the bonnet bore and positioned such that the shaft shoulder is sandwiched between the first radial shoulder and the retaining ring.

5. The ram assembly of claim 1, wherein:

the bonnet further comprises a second radial shoulder;

the ram head and ram stem form a ram shoulder; and the second radial shoulder is configured to abut the ram shoulder when the ram is in the retracted position.

6. A blowout preventer, comprising:

a housing having a main bore extending therethrough and at least one pair of opposing ram bores oriented substantially perpendicularly to the main bore and in communication therewith;

two or more ram assemblies, each ram assembly corresponding with a ram bore of the at least one pair of opposing ram bores and comprising:

a bonnet having a bonnet bore extending therethrough;

a ram shaft axially retained in the bonnet;

a ram having a ram stem and ram head, the ram threadingly coupled to the ram shaft such that rotation of the ram shaft results in axial translation of the ram while the ram shaft remains axially stationary; and ram seals located on the ram head;

wherein the ram moves toward a sealing position when the ram shaft is rotated in a first rotational direction, and the ram moves toward a retracted position when the ram shaft is rotated in a second rotational direction, and further comprising an alignment pin extending into the bonnet bore:

wherein an alignment groove is defined in the ram and the alignment pin engages the alignment groove when the ram is in the retracted position;

the alignment groove is tapered from outer end of the ram towards an inner end of the ram for permitting the ram to rotate when in the sealing position; and the alignment pin cooperates with the alignment groove to return the ram to an initial orientation when the ram is actuated to the retracted position.

7. The blowout preventer of claim 6, wherein each of the two or more ram assemblies further comprise a set of one or more annular seals seated in a set of corresponding seal grooves formed in one of the ram and the bonnet for sealing between the ram and the bonnet.

8. The blowout preventer of claim 6, wherein the ram seals of each of the two or more ram assemblies comprise a rod-engaging portion and a circumferential portion.

9. The blowout preventer of claim 6, wherein:

the ram shaft of each of the two or more ram assemblies comprises a radially extending shaft shoulder;

the bonnet of each of the two or more ram assemblies comprises a first radial shoulder extending into the bonnet bore;

the shaft shoulder and first radial shoulder are configured to abut each another; and each of the two or more ram assemblies further comprise a retaining ring secured in the bonnet bore and positioned such that the shaft shoulder is sandwiched between the first radial shoulder and the retaining ring.

10. The blowout preventer of claim 6, wherein:

the bonnet of each of the two or more ram assemblies further comprises a second radial shoulder;

the ram head and ram stem of each of the two or more ram assemblies form a ram shoulder; and the second radial shoulder is configured to abut the ram shoulder when the ram is in the retracted position.

11. The blowout preventer of claim 6, wherein the housing has a connection means located at an upper end configured to permit a sealing section of a stuffing box to be connected to the housing.

12. The blowout preventer of claim 11, wherein the sealing section comprises a flange portion having a plurality of enlarged apertures for cooperating with the connection means to secure the sealing section to the housing, the enlarged apertures permitting a stuffing box axis of the sealing section to be misaligned with an axis of the main bore.

13. The blowout preventer of claim 11, wherein an upper portion of the main bore has an enlarged diameter.

14. The blowout preventer of claim 6, wherein the at least one pair of opposing ram bores comprises at least a first and second pair of opposing ram bores, the first and second pair of opposing ram bores being axially and angularly offset relative to each other.

* * * * *